US007190252B2

(12) United States Patent
Smith et al.

(10) Patent No.: US 7,190,252 B2
(45) Date of Patent: Mar. 13, 2007

(54) SURFACE MOUNT ELECTRICAL RESISTOR WITH THERMALLY CONDUCTIVE, ELECTRICALLY INSULATIVE FILLER AND METHOD FOR USING SAME

(75) Inventors: Clark L. Smith, Norfolk, NE (US); Thomas L. Veik, Columbus, NE (US); Todd L. Wyatt, Norfolk, NE (US); Thomas L. Bertsch, Pierce, NE (US); Rodney Brune, Columbus, NE (US); William Mac Arthur, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 205 days.

(21) Appl. No.: 11/066,865

(22) Filed: Feb. 25, 2005

(65) Prior Publication Data

US 2006/0197648 A1 Sep. 7, 2006

(51) Int. Cl.
*H01C 1/012* (2006.01)

(52) U.S. Cl. ..... 338/309; 338/22 R; 338/226

(58) Field of Classification Search ..... 338/22 R, 338/51, 52, 59, 159, 277, 306, 308–309, 338/313, 314, 322, 324, 328, 332, 226
See application file for complete search history.

(56) References Cited

U.S. PATENT DOCUMENTS

| | | | | |
|---|---|---|---|---|
| 3,996,447 | A * | 12/1976 | Bouffard et al. | 338/22 R |
| 4,529,958 | A * | 7/1985 | Person et al. | 338/275 |
| 4,829,553 | A | 5/1989 | Shindo et al. | |
| RE33,541 | E * | 2/1991 | Pryst et al. | 338/226 |
| 5,179,366 | A | 1/1993 | Wagner | |
| 5,225,230 | A | 7/1993 | Seaman et al. | |
| 5,287,083 | A | 2/1994 | Person et al. | |
| 5,563,572 | A | 10/1996 | Hetzler | |
| 5,604,477 | A | 2/1997 | Rainer et al. | |
| 5,739,743 | A * | 4/1998 | Mazzochette | 338/313 |
| 6,798,189 | B2 | 9/2004 | Hirasawa | |
| 2004/0233032 | A1 | 11/2004 | Schneekloth et al. | |

FOREIGN PATENT DOCUMENTS

| | | |
|---|---|---|
| DE | 41 43 217 A1 | 7/1992 |
| JP | 60-49611 | 3/1985 |
| JP | 1-109702 | 4/1989 |

* cited by examiner

*Primary Examiner*—Tu Hoang
(74) *Attorney, Agent, or Firm*—McKee, Voorhees & Sease, P.L.C.

(57) ABSTRACT

An electrical resistor is provided with a resistive element and terminations extending from opposite ends of the resistive element. The terminations are folded under the resistive element, with a thermally conductive and electrically insulative filler being sandwiched and bonded between the resistive element and the terminations. The terminations provide for mounting of the resistor to an electronic circuit assembly. The intimate bond between the resistive element, filler and terminations allow for enhanced dissipation of heat generated in the use of the resistive element, so as to produce a resistor which operates at a lower temperature, and improves component reliability.

21 Claims, 7 Drawing Sheets

SURFACE MOUNT ELECTRICAL RESISTOR WITH THERMALLY CONDUCTIVE, ELECTRICALLY INSULATIVE FILLER AND METHOD FOR USING SAME

BACKGROUND OF THE INVENTION

This invention relates to a surface mount electrical resistor with thermally conductive, electrically non-conductive filler and method for using same.

Electronic systems such as cell phones, computers, consumer electronics and the like continue to get smaller and smaller. As the systems shrink in size, smaller electronic components are required. However, the power requirements of the system are not necessarily reduced in magnitude as the electronic systems and their components get physically smaller. Therefore, the heat generated by the components must be managed so as to maintain safe and reliable operating temperatures for the systems.

Resistors are a primary component in the electronic circuit assemblies of these various systems. Prior art resistors have many different designs. Some prior art resistors have terminations that are very short, in comparison to the length of the resistive element, and extend outwardly from the ends of the resistive element. Other prior art resistors have terminations that are long and wrapped underneath the resistive element, but are not optimized for thermal conductivity from the resistive elements, thereby precluding any significant improvement in heat dissipation. Still other prior art terminations for heat dissipation are not used for electrical connection to the circuit assembly. Yet other prior art terminations serve primarily as the electrical connection to a printed circuit board, but also provides the primary means for removing heat from the resistive element. However, all of these prior art terminations have limited size or thermal efficiency and therefore limited capacity for heat dissipation.

Examples of prior art resistors are shown in FIGS. 1 and 2. In FIG. 1, a resistor 11 having a protective coating 30A surrounding a resistance element (not shown) also includes terminals 24A and 25A. The terminals are soldered to pads 12. Only air exists beneath the protective coating 30A, and therefore heat dissipation from the resistance element within 30A is less than is desired.

Another form of prior art resistor 110 is shown in FIG. 2. This resistor 110 includes a resistance element 114 having terminals 124 and 125 bent down beneath the resistance element 114. A coating material 128 surrounds the resistance element 114 and is positioned between the resistance element 114 and the leads 124, 125. As can be seen in FIG. 2, the thickness of the material 128 is represented by the numeral T1, and this is approximately 0.381 mm (which is approximately 15 mils). The thickness of the resistance element itself 114 is represented by the numeral T2 and is approximately 0.1270 mm (5 mils). The material 128 surrounding the resistance element 114 is not attached to or bonded to the leads 124 or 125, but instead the leads 124 or 125 are bent around and into contact with the material 128 after the material 128 has cured and hardened. Furthermore, the thickness T1 is so great as to prevent the enhancement of heat conduction from the resistance element 114 through the material 128 to the leads 124 or 125.

Therefore, a primary objective of the present invention is the provision of an improved electrical resistor having enhanced heat dissipation.

Another objective of the present invention is the provision of a surface mount electrical resistor having a resistive element with terminations extending from the opposite ends of the resistive element and extending under, and in close proximity to [between 0.0254 mm and 0.254 mm (1 mil to 10 mils)], the resistive element.

A further objective of the present invention is the provision of an improved electrical resistor having terminations which provide both electrical and enhanced thermal conductivity from the resistive element.

A further objective of the present invention is the provision of a method of making an electrical resistor including the step of extending the terminations under the resistive element so that a thermally conductive and electrically insulated filler material of minimal thickness is sandwiched between the resistive element and the terminations prior to curing the filler material.

A further objective of the present invention is the provision of a resistor wherein the filter material is bonded both to the resistive element and the two terminations so as to enhance heat conduction from the resistive element to the terminations.

Yet another objective of the present invention is the provision of a surface mounted electrical resistor which is economical to manufacture and which functions at a lower temperature than prior art resistors of equal size and power load.

These and other objectives will become apparent from the following description of the invention.

SUMMARY OF THE INVENTION

The foregoing objects may be achieved by an electrical resistor comprising a resistive element having opposite ends, an upper surface and a lower surface. A first termination is at one of the opposite ends of the resistive element. A second termination is at the other of the opposite ends of the resistive element. The first and second terminations each extend under the lower surface of the resistive element and have a termination surface spaced a predetermined first space away from the resistance element. The first and second terminations are electrically disconnected from one another except through the resistive element. A thermally conductive and electrically non-conductive filler engages and is bonded to the lower surface of the resistive element and is also bonded to the termination surfaces of the first and second terminations. Thus the thermally conductive and electrically non-conductive filler is in heat conducting relation to both the resistive element and the first and second terminations whereby heat will be conducted from the resistive element through the filler to the first and second terminations.

According to another feature of the present invention the space between the lower surface of the resistive element and the termination surfaces of the first and second terminations is in the range of 0.0254 mm to 0.254 mm (1 mil to 10 mils).

According to another feature of the present invention the space has a thickness of less than 0.127 mm (5 mils) between the resistance element and the first and second terminations.

According to another feature of the present invention the second ends of the first and second terminations face one another and are spaced apart from one another to create a termination space therebetween ranging from 0.0508 mm (2 mils) to one third of the overall resistor's length. The filler extends at least partially within the termination space, but it is not necessary for purposes of the invention that the filler extend within the termination space.

According to another feature of the present invention an electrically non-conductive coating is on the top surface of the resistance element and provides a protective coating thereto.

According to another feature of the present invention an electrical circuit board having two or more electrical conductors thereon is attached to the first and second terminations.

According to another feature of the present invention the first and second terminations are made from a material that is electrically and heat conductive.

According to another feature of the present invention the filler is a material selected from the group consisting essentially of plastic, rubber, ceramics, elastomer and electrically insulated metal and glass.

The method of the present invention comprises placing a thermally conductive and electrically non-conductive filler in an uncured and unhardened state on the lower surface of the resistance element. The first and second terminations are bent downwardly to a position spaced below the lower surface of the resistance element. The first and second terminations are forced into contact with the filler material while the filler material remains in the uncured and unhardened state. Then the filler is permitted to cure and harden while in contact with the lower surface of the resistance element and the first and second terminations so that the filler will conduct heat from the resistance element to the first and second terminations.

According to another feature of the method of the present invention, the distance is maintained between the lower surface of the resistance element and the first and second terminations in a range of 0.0254 mm to 0.254 mm (1 mil to 10 mils).

According to another feature of the present invention, the distance is maintained at less than 0.1270 mm (5 mils).

According to another feature of the present invention, the filler is bonded to both the lower surface of the resistance element and the first and second terminations so as to enhance the ability of the filler to conduct heat from the resistance element to the first and second terminations.

DETAILED DESCRIPTION OF THE PREFERRED EMBODIMENT

Figure 3:
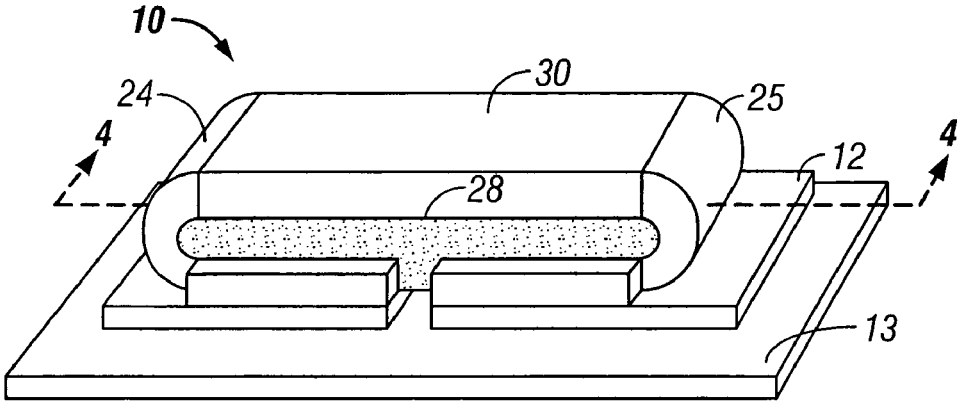
FIG. 3 is a perspective view of the resistor of the present invention shown mounted upon a printed circuit board.
Figure 4:
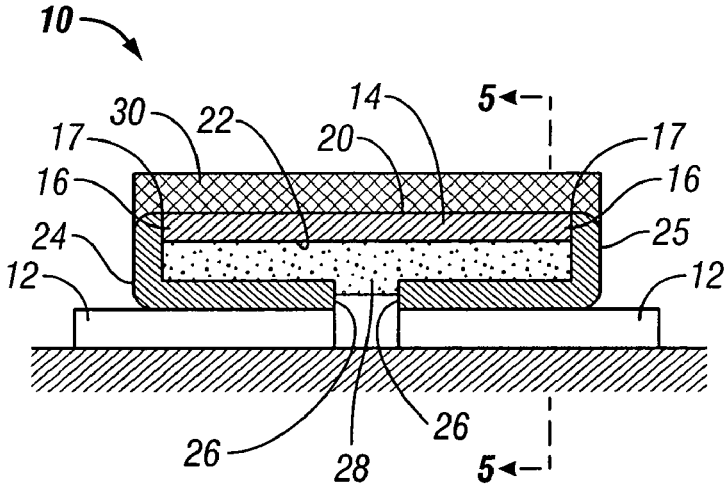
FIG. 4 is a sectional view of the resistor of FIG. 3 taken along line 4—4 of FIG. 3.
Figure 5:
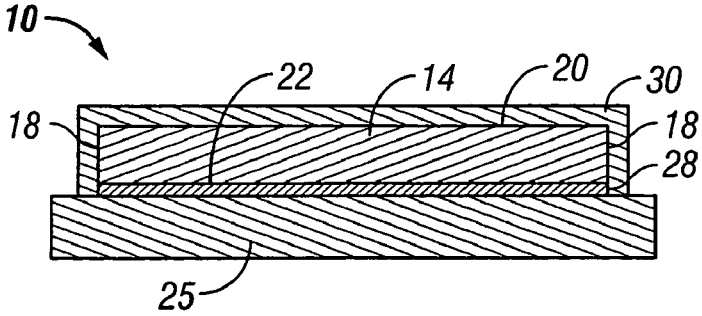
FIG. 5 is a sectional view of the resistor taken along lines 5—5 of FIG. 4.
Figure 6:
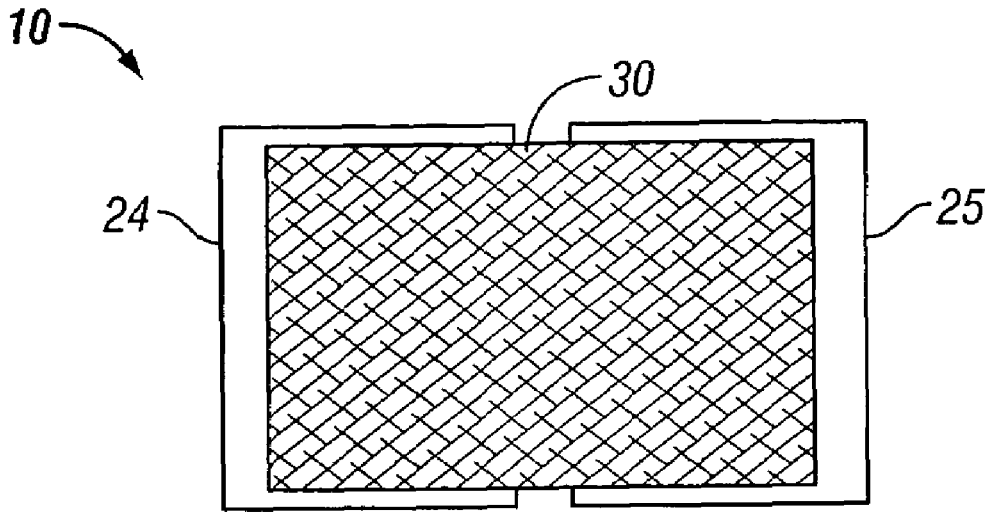
FIG. 6 is a top plan view of the resistor.
Figure 7:
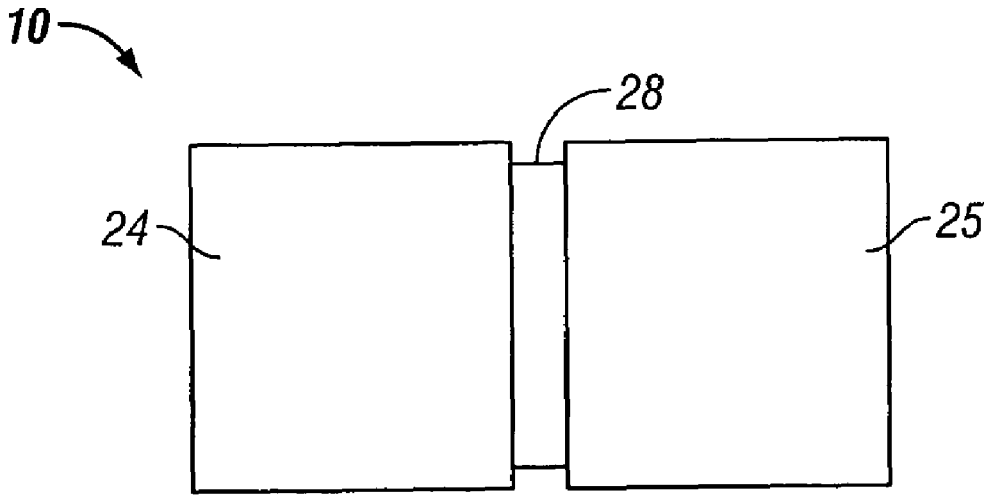
FIG. 7 is a bottom plan view of the resistor.

The resistor of the present invention is generally designated in the drawings by the reference numeral 10. The resistor 10 is a surface-mount resistor adapted to be mounted on an electrical circuit assembly, such as pads 12 on circuit board 13. The resistor 10 includes a resistive element 14 having opposite ends 16, opposite sides 18, a top surface 20 and a bottom surface 22. The resistor 10 also includes terminals or terminations 24 and 25 extending from the opposite ends 16 of the resistive element 14. The terminations 24, 25 are welded to the ends of resistance element 14 along weld lines 17. The terminations 24 and 25 are elongated and folded to a position beneath the resistive element 14, as seen in FIGS. 3 and 4. The outer ends 26 of the terminations are closely spaced with a small gap there between. The distance between the outer ends 26 is in the range of 0.0254 mm (2 mil) to one-third of the length of resistor 10. Normally this is about 0.5 ml (20 mils).

A thermally conductive and electrically non-conductive filler 28 fills the space between the bottom 22 of the resistive element 14 and the terminations 24 and 25, as best seen in FIGS. 3 and 4. The filler 28 may or may not, extend into the gap between the outer ends 26 of the terminations 24 and 25. The filler 28 may in its uncured state be a liquid, tape, paste, or putty type material, or a combination of these material configurations. In its uncured state the filler 28 should be capable of being depressed or squeezed between the terminations 24, 25 and the resistive element 14 so as to be in heat conducting relationship with both terminations 24, 25 and the bottom 22 of resistive element 14. Upon curing the filler 28 will form a bond with both terminations 24, 25 and bottom 22 of resistive element 14.

The filler material 28 may be any material that is highly thermal conductive and electrically non-conductive CLS. The filler 28 may also be selected from plastics, rubbers, ceramics, electrically insulated metals, glasses, and like materials. The filler 28 may be an epoxy, silicone, silicone polyester copolymer, elastomer. Since the filler 28 is not the primary source of structural strength, it may be very thin to enhance thermal conduction. For efficient heat transfer, the filler 28 should be as thin as possible, for example, within the range of 0.0254 mm to 0.254 mm (1–10 mils). Preferably it is between 0.0254 mm to 0.1270 mm (1–5 mils). The filler 28 may also include particles of a material to enhance thermal conductivity that may be but are not limited to an electrically insulated metal or ceramic material, or a sheet of electrically insulated metal, or a combination thereof, so as to promote heat transfer through the filler 28. The particles may be selected from, among other things, aluminum oxide, boron nitride, aluminum nitride, dielectrically coated copper, anodized aluminum or any combination thereof.

An example for filler 28 is a homogeneous polyimide film manufactured by DuPont High Performance Materials, Circleville, Ohio 43113 under the trade designation Kapton® MT. The filler 28 may also be mixed with a boron nitride industrial powder manufactured under the name COMBAT®", grade PH((325, by Saint-Gobain Adraneed Nitride Products, Amherst, N.Y. 14228-2027. This powder enhances the heat conducting properties of filler 28, but is chemically inert.

The filler 28 electrically isolates the terminations 24 and 25 from the resistive element 14, except at the connection of the terminations 24 and 25 to the ends 16 of the resistive element. An electrical connection between the terminations 24 and 25 and any other point on the resistive element 14 will cause a short circuit and reduces the resistance from the designed resistance value of the resistor 10. The terminations 24 and 25, filler 28, and resistive element 14 should have intimate or direct contact to enhance heat transfer through the three layers. Air bubbles between these components inhibit heat transfer and should be avoided.

The resistor 10 also includes a protective coating 30 on the side edges 18 and top surface 20 of the resistive element 14. The coating 30 is not applied to the bottom side 22 of the resistive element 14. The coating 30 is marked by printing ink or laser with identifying indicia for the resistor 10. The coating 30 is a dielectric material. The coating 30 provides protection for the resistor from various environments to which the resistor is exposed, and adds rigidity to the resistive element 14. The coating 30 also insulates the resistor 10 from other components or metallic surfaces it may contact during installation or operation. The coating 30 may be roll coated, printed or sprayed to the side edges 18 and top surface 20 of the resistive element.

The resistor 10 may be manufactured in a strip assembly similar to the resistor manufacturing method described in U.S. Pat. No. 5,604,477 to Rainer, which is incorporated herein by reference. The resistor may also be manufactured as individuals without the strip assembly.

The resistors 10 are next passed through an adjustment and calibration station, which adjusts each resistor 10 to the desired resistance value by cutting one or more alternating trimming slots into the side edges 18 of the resistive element 14 as described in U.S. Pat. No. 5,604,477. The resistor 10 in the drawings is shown without the trimming slots and resistor 10 can be made with, or without, the trimming slots.

The method of forming the individual resistor 10 is shown in FIGS. 8A–8G.

Figure 8A:
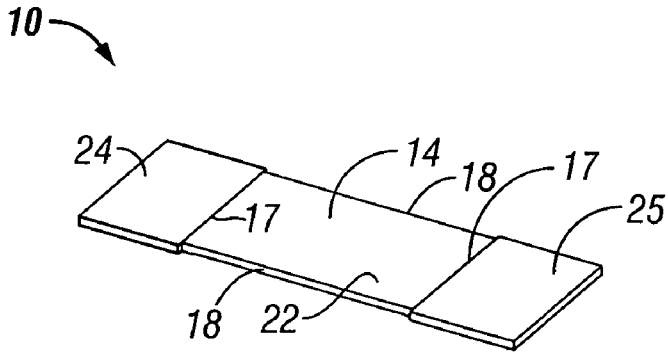
FIGS. 8A–8G are perspective views showing the steps in the manufacture of one of the resistors, without the protective coating.
Figure 8B:
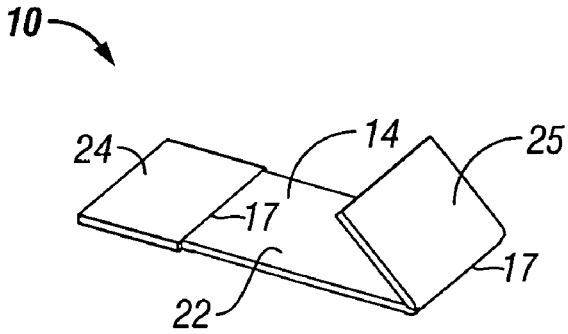
Figure 8C:
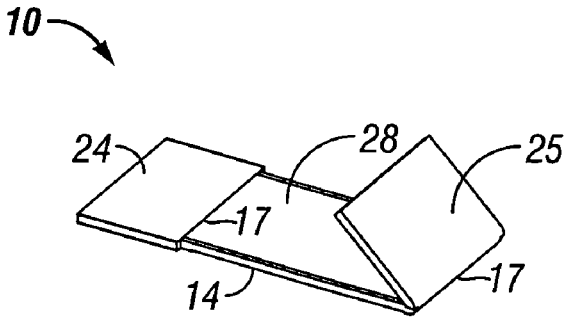

As can be seen in FIG. 8A, the resistor 10 is comprised of a termination 24, a termination 25, which are welded to the ends 16 of a resistance element 14 at weld line 17. Resistance element 14 includes a bottom surface 22 which is shown in FIG. 8A in an upwardly presented direction.

The resistance element 14 and terminals 24 and 25 as shown in FIG. 8A are then dipped or otherwise immersed in a liquid primer material. An example of a primer material which can be used for the present purpose is a material manufactured by Dow Corning Corporation, Midland, Mich. 48686 under the trademark SYLGARD®. This material is in a liquid form and is adapted to cure at room temperature in the range of 20 to 90% relative humidity for one to two hours. The resistance element, after being immersed in the Dow Corning SYLGARD® material is then bent in the form shown in FIG. 8B. This includes the terminal 25 being bent to a 45° angle. The primer material that is applied to the resistance element and terminals is an adhesion promoter and leaves a chemical coating on the entire surface of resistor 10. Temperature may be applied to increase the speed with which it cures and dries.

The next step in the process involves the application of the filler material 28. Filler material 28 includes a tape manufactured by DuPont High Performance Materials located in Circleville, Ohio 43113 under the trade designation KAPTON® MT thermally conductive substrate polyimide film. The primer material described above is placed on the KAPTON® tape on both sides by means of a bath, and is permitted to dry. KAPTON® tape is then pulled through a machine block die which applies a mixture of two materials in the same nature as a braiding process. The thickness of this mixture is approximately 0.0762 (3 mils) on each side of the KAPTON® tape. The mixture of materials includes a material manufactured by Dow Corning Electronic Solutions under the trade designation Q1-4010. This is a conformal coating of thermally conductive, but electrically non-conductive material. It is adapted to be applied in an uncured state for curing at a later time. The Q1-4010 conformal coating is mixed with a nitride powder manufactured by Saint-Gobain Ceramics Boron Nitride Products in Amherst, N.Y. 14228-2027, under the trademark COMBAT® Boron Nitride Industrial Powders, Grade PHPP325. The Q1-4010 conformal coating is mixed with this COMBAT® Boron Nitride Industrial Powder to create a mixture. The COMBAT® Boron Nitride powder is in general inert, and does not enter into a chemical reaction with the Q1-4010. However, it does enhance the temperature conducting nature of the mixture of Q1-4010 conformal coating and the COMBAT®.

Figure 8D:
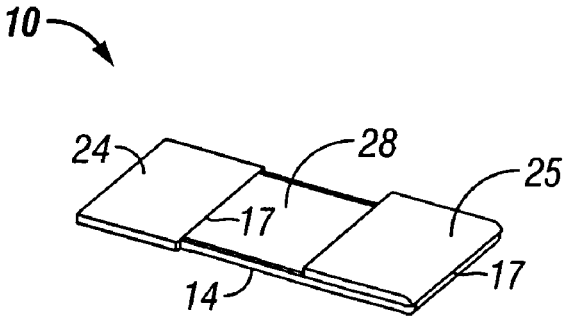

FIG. 8D shows the bending of the termination 25 downwardly into contact with the as yet uncured filler material 28 which is comprised of the KAPTON® tape coated with the mixture of Q1-4010 conformal coating and the COMBAT® PHPP325A Boron Nitride Powder. Because the material 28 is not in a cured state as yet, the bending of the terminal 25 into contact therewith causes a depression in the filler material 28 thereby causing the material 28 to ooze around the side edges and end of terminal 25.

Figure 8E:
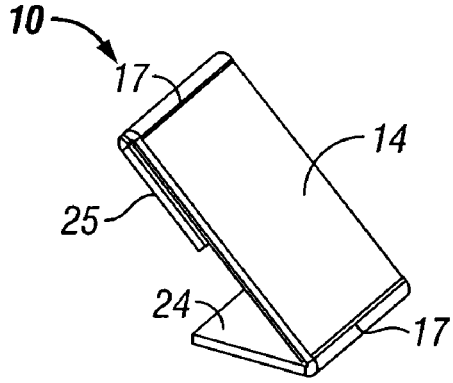
Figure 8F:
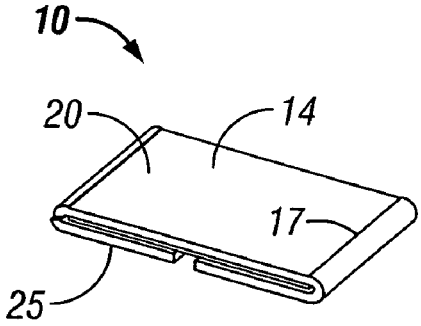
Figure 8G:
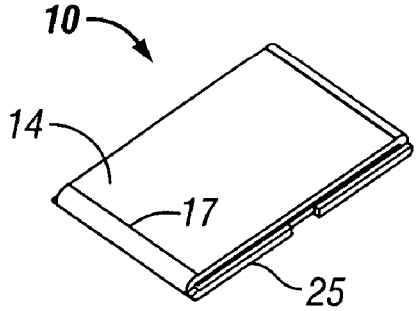

FIG. 8E shows the step of bending the termination 24 to a 45° angle and FIGS. 8F and 8G show the bending of the termination 24 into contact with the as yet uncured filler material 28 in the same manner as described above with respect to termination 25. After the resistance element has been formed into the shape shown in FIGS. 8F and 8G the filler material 28 is permitted to cure and harden. When it cures and hardens it forms a bond between both the resistance element 14 and the terminals 24, 25. The terminals 24, 25, because they are bent into contact with the filler material 28 before the filler material 28 is cured cause the material 28 to be pressed against the resistance element 14 and also to be depressed by the terminals 24, 25. After a bond forms, the resistance element 14 is capable of dissipating heat through the filler material 28, the terminals 24, 25, and into the circuit pads 12 on circuit board 13. A solderable coating may be applied to the terminals 24, 25 at this point if the terminals 24, 25 were not pre-coated with solder.

The resistors 10 of the present invention have much lower operating temperatures than the prior art resistors. For example, with the resistor shown and described in the U.S. Pat. No. 5,604,477 patent, at two watts, there is an element hot spot temperature of 275° C. In comparison, with the resistor 10 of the present invention, the temperature at two watts is approximately 90° C. The lower operating temperature correlates to better electrical performance and reliability. As shown in FIG. 3, the heat generated by the resistive element 14 is dissipated through the thermally conductive terminations 24, 25 and the thermally conductive filler 28. The elongated terminations 24, 25 preferably have a thickness substantially identical to that of the resistive element 14. Thus, the terminations 24, 25 provide maximum surface area and minimum thickness for the dissipation of heat from the resistive element 14. The reasons for this improved heat dissipation are at least partially due to the bonding of filler 28 to both the resistance element 14 and the terminations 24, 25, and also partially due to the thinness of the filler 28 between 0.0254 mm and 0.254 mm.

Other reasons for improved heat dissipation include the fact that the terminations are bent into contact with the filler before the filler 28 is cured and is still pliable. Thus, the filler 28 is depressed during the manufacturing process to a minimal thickness before curing. Secondly, the manufacturing process allows the pliable filler 28 to conform to the element 14 and terminations 24, 25 so as to prevent air bubbles which inhibit thermal conductivity. Thirdly, curing the filler 28 after forming bonds the resistive element 14 and terminations 24, 25 to the filler 28 to create intimate contact for maximum heat transfer. Thus, the heat transfer of the resistor 10 is enhanced by creating a path from the element through the filler 28 and termination 24 or 25.

Figure 9:
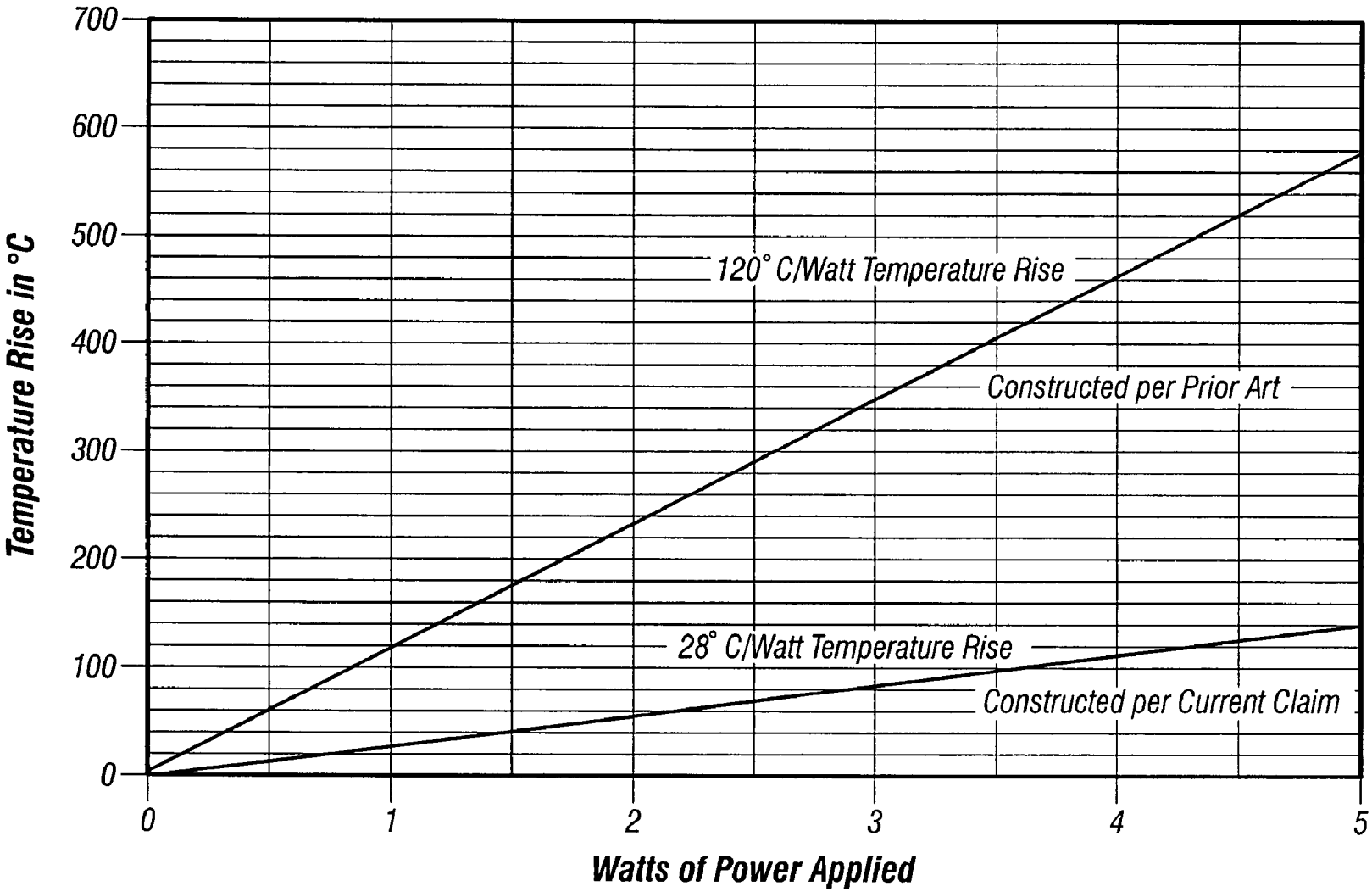
FIG. 9 is a chart comparing the temperature rise of the present invention with the temperature rise of resistors made according to the prior art.

FIG. 9 shows a comparison of the temperature rises of the present invention to resistors constructed according to the prior art. As can be seen from this chart the present invention produces a temperature rise of 28° C./Watt whereas resistors made according to the prior art produce a temperature rise of 120° C./Watts—a dramatic difference.

Figure 1:
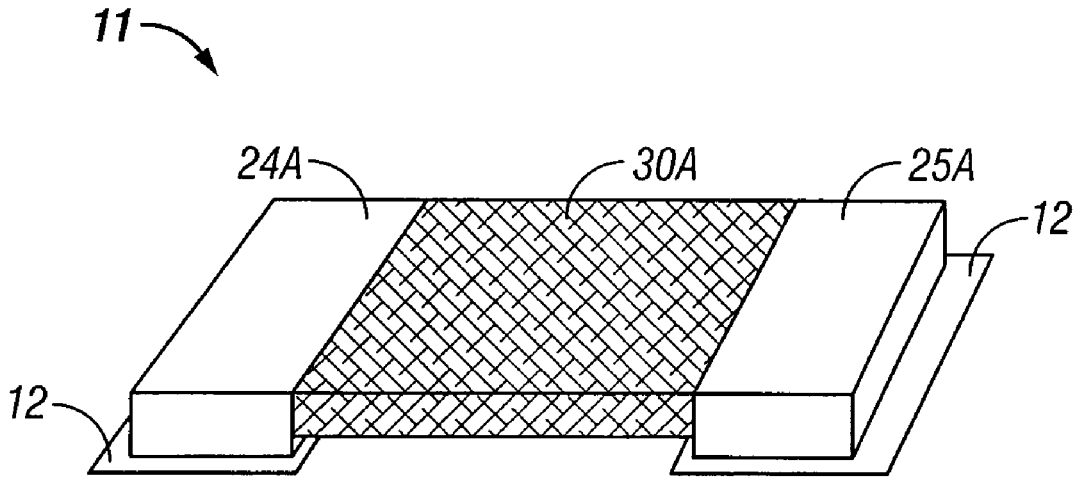
FIG. 1 (Prior Art)
FIG. 1 is a perspective view of a prior art resistor.
Figure 2:
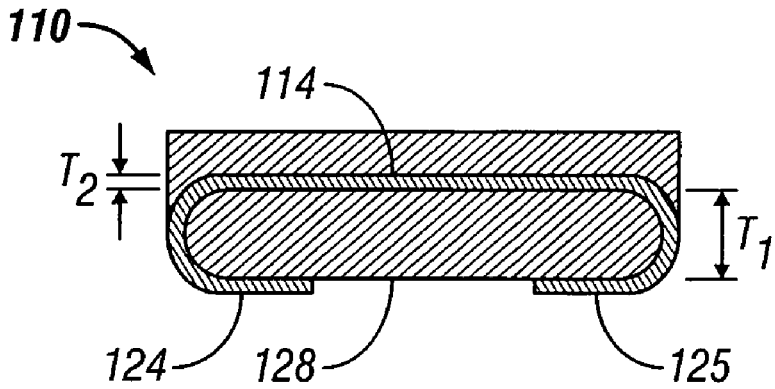
FIG. 2 (Prior Art)
FIG. 2 is a sectional view of another prior art resistor.

The prior art resistor 110 shown in FIG. 2 includes a resistor element 114 with terminations 124, 125 folded under the element 114. Filler 128 resides between the element 114 and the terminations 124, 125. The filler 128 is approximately 0.015" thick, three times the thickness of the element 114, which is too thick for efficient heat transfer. The heat will not pass downward through the thick filler 128 in the most efficient manner, but rather must travel laterally through the ends of the element 114 into the terminations 124, 125. Also, in the resistor 110, the filler 128 is molded around the element 114 before the terminations 124, 125 are folded under, thus allowing air gaps between the filler 128 and the terminations. Such air gaps inhibit heat transfer.

Figure 10:
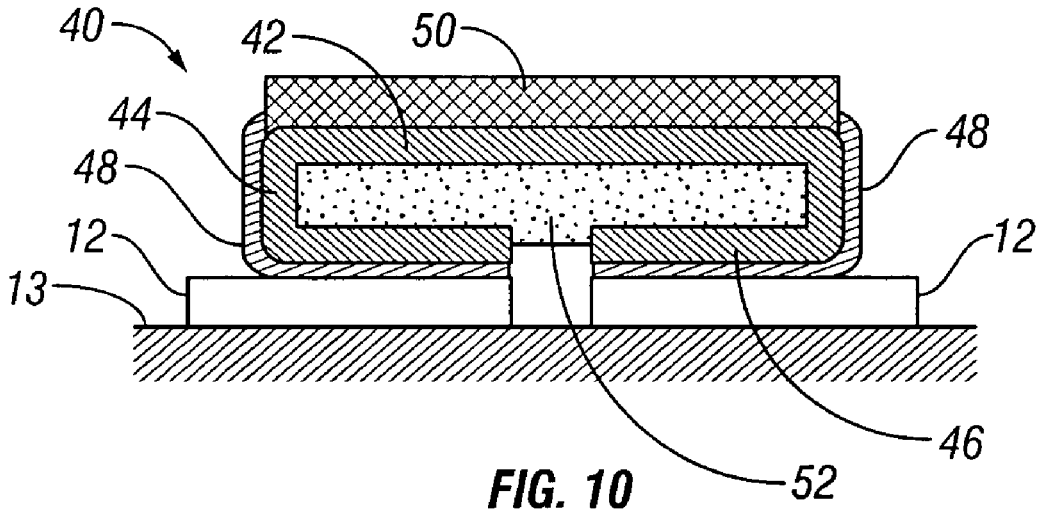
FIG. 10 is a view similar to FIG. 4, but showing a modified form of the resistor.

FIG. 10 shows a view similar to FIG. 4, but showing a modified form of the resistor designated generally by the numeral 40. Resistor 40 includes a resistive element 42 which forms terminations 44, 46 that are folded underneath the resistance element 42. It should be noted that the resistance element 42 is integral, one, or homogenous with the terminations 44, 46, being made of the same material. A conductive coating 48 is applied over the outer surface and the under surface of the terminations 44, 46 so as to provide electrical conductivity. The conductive coating 48 is in contact with the pads 12, and can be attached to the pads 12 by the use of solder. In this variation the filler 52 is provided between the terminals 44, 46 and the resistance element 42. A non-conductive coating 50 is applied to the upper surface of the resistance element 42. The heat is conducted from the resistance element 42 downwardly through the filler 52 into the terminations 44, 46, and ultimately through the conductive coating 48 to the pads 12.

Figure 11:
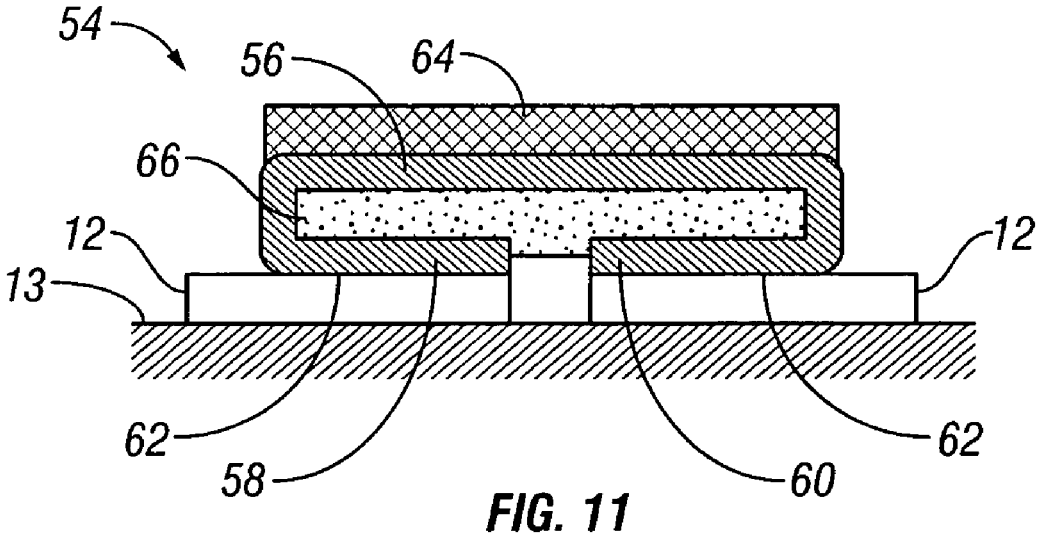
FIG. 11 is a view similar to FIG. 4, but showing a modified form of the resistor.

FIG. 11 is a view similar to FIG. 4 but showing a further modification designated by the numeral 54. Resistor 54 includes a resistance element 56 which is bent at its ends to form terminations 58, 60. The resistance element 56 is not coated with conductive material such as shown at 48 at FIG. 10. However, a solder 62 is applied between the terminations 58, 60 so as to attach the resistor 54 to the pads 12. A non-conductive coating 64 is applied to the upper surface of the resistance element 56, and a filler 66 is provided to conduct heat from the resistance element 56 through the filler, through the terminations 58, 60, through the solder 62, and into the pads 12.

Thus by a comparison of FIGS. 4, 10 and 11 it can be seen that the terminations 24, 25 can be welded to the resistance element 14 as shown in FIG. 4; can be integral with the resistance element 42 as shown in FIG. 10, but coated with a conductive coating 48; or can be made integral with the resistance element 56 without any conductive coating 48 as shown in FIG. 11.

It is understood that the concept of the present invention may be applied to other electronic components that generate heat during operation, such as inductors, semi-conductors, and capacitors.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An electrical resistor comprising:

a resistive element having opposite ends, an upper surface and a lower surface;

a first termination having a first end and a second end, the second end having an upwardly presented termination surface spaced a first space below the lower surface of the resistive element;

a second termination having a first end and a second end the second end having an upwardly presented termination surface spaced a second space below the lower surface of the resistive element;

the first and second terminations being electrically disconnected from one another except through the resistive element;

a thermally conductive and electrically non-conductive filler filling the first and second spaces;

the upwardly presented termination surfaces of the first and second terminations forming a depression in the filler;

the filler engaging, and being bonded to the lower surface of the resistive element and bonded at the depression of the filler to the upwardly presented termination surfaces of the first and second terminations; and the filler being an electrical non conductor and a heat conductor so that the filler is in heat conducting relation to both the resistive element and the first and second terminations whereby heat will be conducted from the resistive element through the filler to the first and second terminations.

2. The electrical resistor according to claim 1 wherein the first and second terminations are welded to the resistance elements.

3. The electrical resistor according to claim 1 wherein the first and second terminations are integral with the resistance element.

4. The electrical resistor according to claim 3 wherein the first and second terminations each include a downwardly presented surface, a conductive coating covering at least a portion of downwardly presented surfaces of the first and second terminations.

5. The electrical resistor according to claim 3 wherein the downwardly presented surfaces of the first and second terminations are covered with solderable coating.

6. The electrical resistor according to claim 1 and further characterized by the first and second spaces between the lower surface of the resistive element and the termination surfaces of the first and second terminations is in the range of 0.0254 mm to 0.254 mm (1 mil to 10 mils).

7. The electrical resistor according to claim 1 and further characterized by the second ends of the first and second terminations facing one another and being spaced apart from one another to create a termination space there between, the filler extending at least partially within the termination space.

8. The electrical resistor according to claim 1 wherein an electrically non-conductive coating is on the top surface of the resistive element and provides a protective coating thereto.

9. The electrical resistor according to claim 1 and further comprising an electrical circuit board having two or more electrical conductors thereon, the first and second terminations being attached to two or more of the two or more electrical conductors.

10. The electrical resistor according to claim 1 wherein the filler is a material selected from the group consisting essentially of plastic, rubber, ceramics, and electrically insulated metal and glass.

11. The electrical resistor according to claim 1 wherein first and second spaces have a thickness of less than 0.1270 mm (5 mils) between the resistance element and the first and second terminations.

12. An electrical resistor comprising:

a resistive element having opposite ends, an upper surface and a lower surface;

a first termination extending from one of the opposite ends of the resistive element;

a second termination extending from the other of the opposite ends of the resistive element;

the first and second terminations each having a second end extending under the lower surface of the resistive element and having a termination surface spaced a predetermined first space away from the resistance element, the first and second terminations being electrically disconnected from one another except through the resistive element;

a thermally conductive and electrically non-conductive filler, the filler engaging the lower surface of the resistive element and the termination surfaces of the first and second terminations, and being in heat conducting relation to both the resistive element and the first and second terminations whereby heat will be conducted from the resistive element through the filler to the first and second terminations; and the first space having a thickness between the resistive element and the first and second terminations of between 0.0254 mm and 0.254 mm (1 mil and 10 mils).

13. The electrical resistor according to claim 12 wherein the first space has a thickness between the resistive element and the first and second terminations of less than 0.1270 mm (5 mils).

14. The electrical resistor according to claim 12 wherein the filler is bonded to both the lower surface of the resistance element and the first and second terminals.

15. A method for making an electrical resistor having a resistance element including first and second opposite ends, an upper surface, and a lower surface; a first termination extending from the first end of the resistance element; and a second termination extending from the second end of the resistance element; the method comprising:

placing a thermally conductive and electrically non-conductive filler in an uncured and unhardened state on the lower surface of the resistance element;

bending the first and second terminations downwardly to a position spaced below the lower surface of the resistance element;

forcing the first and second terminations into contact with the filler material while the filler material remains in the uncured and unhardened state; and permitting the filler material to cure and harden while in contact with the lower surface of the resistance element and the first and second terminations whereby the filler will conduct heat from the resistance element to the first and second terminations.

16. The method according to claim 15 and further comprising maintaining the distance between the lower surface of the resistance element and the first and second terminations in the range of 0.0254 mm to 0.254 mm (1 mil to 10 mils).

17. The method according to claim 16 and further comprising maintaining the distance between the lower surface of the resistance element and the first and second terminations less than 0.1270 mm (5 mils).

18. The method according to claim 15 and further comprising bonding the filler to both the lower surface of the resistance element and the first and second terminations so as to enhance the ability of the filler to conduct heat from the resistance element to the first and second terminations.

19. A method for making an electrical resistor comprising:

taking a resistance element including first and second opposite ends, an upper surface, and a lower surface the first end having a first termination extending therefrom, the second end having a second termination extending therefrom;

placing an uncured and unhardened thermally conductive and electrically non-conductive filler on the lower surface of the resistance element;

bending the first and second terminations downwardly to a position spaced below the lower surface of the resistance element, the first and second terminations each having an upwardly presented surface spaced first and second spaces respectively below the lower surface of the resistance element;

squeezing the upwardly presented surfaces of the first and second terminations toward the uncured filler whereby the uncured filler will be pressed against the lower surface of the resistance element;

curing and hardening the filler whereby the cured and hardened filler will form a bond between the lower surface of the resistance element and the upwardly presented surfaces of the first and second terminations and will conduct heat from the resistance element to the first and second terminals.

20. A method according to claim 19 and further comprising electrically connecting a first end of each of the first and second terminations to the first and second ends of the resistance element respectively.

21. A method according to claim 19 and further comprising extending the first and second ends of the resistance element to form the first and second terminations, and coating the first and second terminations at least partially with a conductive material.

* * * * *